United States Patent [19]

Struck et al.

[11] Patent Number: 4,873,121

[45] **Date of Patent: * Oct. 10, 1989**

[54] CATHODE/MEMBRANE ASSEMBLY AND METHOD OF MAKING SAME

[75] Inventors: Bernd D. Struck, Langerwehe; Herbert Neumeister; Aristides Naoumidis, both of Jülich, all of Fed. Rep. of Germany

[73] Assignee: Kernforschungsaniage Julich GmbH, Jülich, Fed. Rep. of Germany

[ * ] Notice: The portion of the term of this patent subsequent to Oct. 27, 2004 has been disclaimed.

[21] Appl. No.: 118,416

[22] Filed: Nov. 6, 1987

Related U.S. Application Data

[62] Division of Ser. No. 34,018, Apr. 1, 1987, abandoned.

[30] Foreign Application Priority Data

Apr. 9, 1986 [DE] Fed. Rep. of Germany ..... 3611938

[51] Int. Cl.[4] ..... B05D 5/12; C25B 13/00

[52] U.S. Cl. ..... 427/77; 204/282; 204/290 R; 204/294; 204/296; 427/113; 427/228

[58] Field of Search ..... 204/252, 282, 283, 290 R, 204/294, 296; 427/77, 113, 228, 126.1

[56] References Cited

U.S. PATENT DOCUMENTS

| | | | |
|---|---|---|---|
| 3,860,443 | 1/1975 | Lachman et al. | 427/113 |
| 4,253,922 | 3/1981 | Welch | 204/98 |
| 4,330,387 | 5/1982 | Astruc et al. | 204/284 |
| 4,654,104 | 3/1987 | McIntyre et al. | 204/283 |
| 4,702,784 | 10/1987 | Naumidis et al. | 204/294 |

*Primary Examiner*—John F. Niebling
*Assistant Examiner*—Kathryn Gorgos
*Attorney, Agent, or Firm*—Herbert Dubno

[57] ABSTRACT

A cathode/membrane assembly for an electrolysis cell capable of producing hydrogen in a cathode compartment, utilizes as the cathode material on a proton-permeable solid-electrolite ion-exchange membrane, a layer of porous graphite in the form of carbonaceous fibers coated with tungsten carbide. The graphite felt can be impregnated with an aqueous solution of para-ammoniumtungstate or with an alcoholic solution of tungsten hexachloride and the tungsten compounds are then converted to the tungsten oxides. The tungsten oxide coated graphite felt is then subjected to carburization at a temperature of 620° to 950° C. in a carburizing atmosphere, preferably a flowing $CO/CO_2$ mixture.

5 Claims, 1 Drawing Sheet

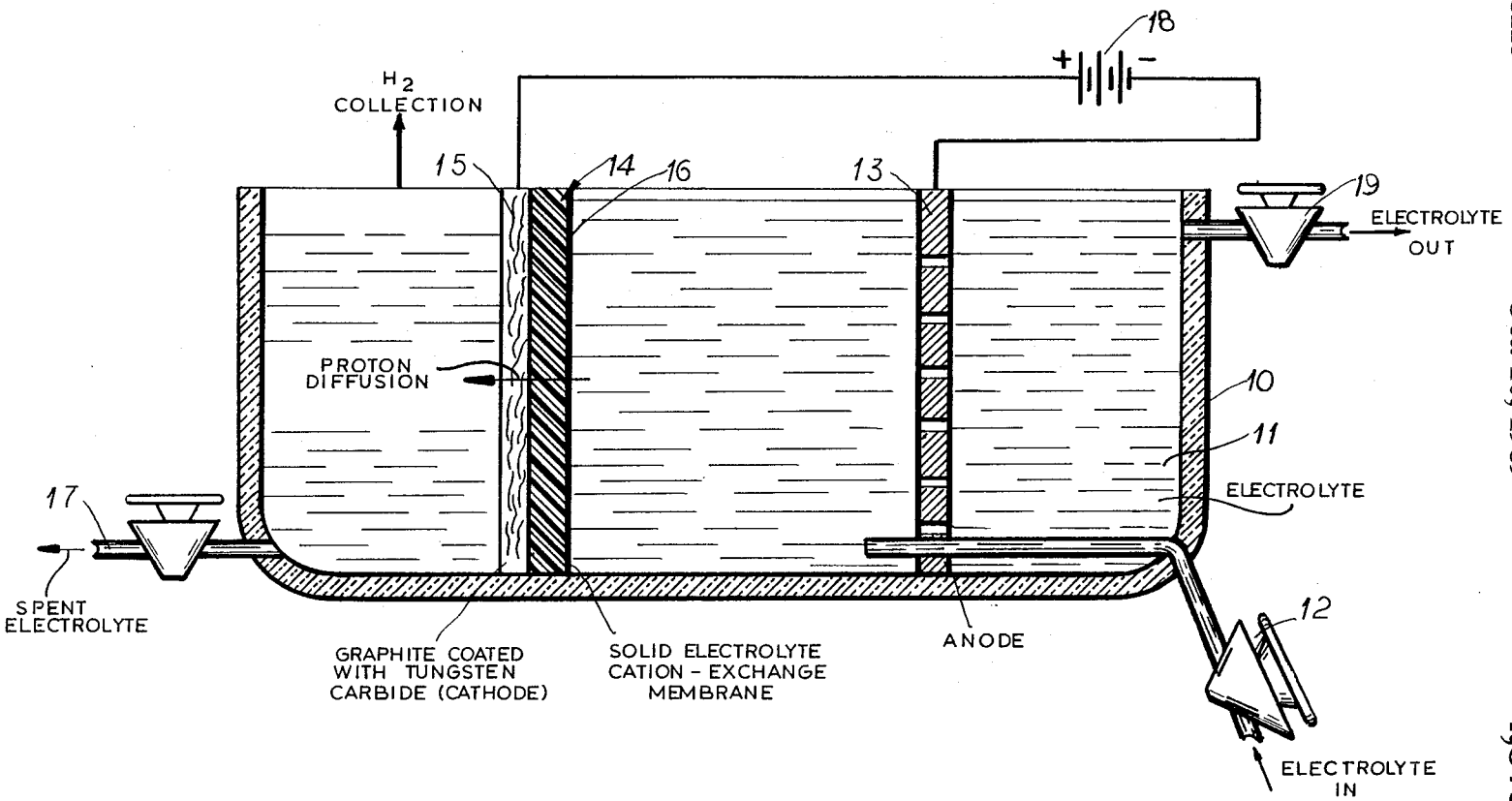
ELECTROLYTE OUT
19
18
+
-
10
11
ELECTROLYTE
12
ELECTROLYTE IN
ANODE
13
SOLID ELECTROLYTE CATION - EXCHANGE MEMBRANE
16
14
15
GRAPHITE COATED WITH TUNGSTEN CARBIDE (CATHODE)
$H_2$ COLLECTION
PROTON DIFFUSION
17
SPENT ELECTROLYTE

CATHODE/MEMBRANE ASSEMBLY AND METHOD OF MAKING SAME

This is a divisional of co-pending application Ser. No. 034,018 filed on 1 April 1987, now abandoned.

FIELD OF THE INVENTION

Our present invention relates to a cathode/membrane assembly and to a method of making the same. More particularly, this inention relates to a cathode/membrane assembly of the type in which a proton-conductive or proton-permeable ion-exchange membrane in the form of a solid electrolyte is provided with a thin layer of cathodic material adapted to constitute the cathode in the cathode compartment of an electrolysis cell.

BACKGROUND OF THE INVENTION

Cathode/membrane assemblies of the aforedescribed type are utilized to provide the cathode which may be required in SPE water electrolysis. The expression "SPE" refers here to solid polymer electrolyte processes.

Such processes include electrolysis for the generation of hydrogen using an electrolyte forming an acidic medium, and SPE hydrochloric acid electrolysis and even electrolysis of sulfuric acid may be carried out in these processes. Other processes in which such units are applicable are the cathodic generation of hydrogen concurrently with anodic oxidation of sulfur dioxide in sulfuric acid electrolyte. A specific example of this latter process is the electrochemical oxidation of $SO_2$ from exhaust gases concurrently with the generation of $H_2$ and the analogous electrolysis in the sulfuric acid hybrid process.

Cathode/membrane assemblies of the aforedescribed type can make use of the commercial membrane material known under the name of NAFION ® which has been coated on both sides with platinum, the latter serving as a catalyst (e.g. for use in the sulfuric acid hybrid circulation process). The assembly thus constituted has been found to be applicable in an SPE electrolysis cell, i.e. an electrolysis cell using an ion exchange membrane as the separator.

The anolyte can be $SO_2$-saturated sulfuric acid. An additional liquid catholyte is not required.

In the operation of such electrolysis cells it has been found that there is a tendency to cathodically reduce some of the $SO_2$ and thus produce sulfur or hydrogen sulfide which can act as poison to the catalytically active platinum coating on the cathode side. This, of course, defeats the purpose of the cathode coating and efforts to eliminate the problem have been frustrated by the fact that up to now no proton-conductive ion exchange material has been found which is not also at least somewhat permeable to sulfur dioxide.

OBJECTS OF THE INVENTION

It is, therefore, the principal object of the present invention to provide an improved cathode/membrane assembly which overcomes the aforementioned drawbacks.

A more specific object of this invention is to provide a cathode/membrane unit which is free from noble metals and especially metals which have a tendency to be poisoned by the formation of sulfur and hydrogen sulfide and thus to provide an improved cathode/membrane assembly which is not susceptible to sulfur or hydrogen sulfide poisoning.

Still another object of the invention is to provide an improved method of making a cathode/membrane assembly for the purposes described and, of course, to a process for making the improved cathode/membrane assembly.

SUMMARY OF THE INVENTION

These objects are attained, in accordance with the present invention in a cathode/membrane assembly or unit which on the cathode side of the ion exchange membrane, is provided with a tungsten carbide coated porous graphite in the form of a carbon fiber material.

The carbon fiber material has the requisite flexibility to enable it to be applied to the ion exchange membrane which can be a commercial product such as NAFION ®, NEOSEPTA ® or RAIPORE ®. The flexibility is important to permit the cathode formed from the tungsten carbide coated graphite onto the membrane.

Carbon fiber materials which can be used can be mats or felt which are carbon or graphite felt, hard felt which are self-supporting materials composed of carbon or graphite fibers, or graphite or carbon fiber papers formed from thin fleeces of carbon stape fibers. The bonding of the fibers in the fabrication of such papers is generally effected by means of synthetic resins which inn the carburization treatment described below can be decomposed leaving only graphite or carbon behind.

For coating the carbon fiber materials adapted to form the porous graphite, with tungsten carbide, we may use a process of the type described in German Open Application DE-OS 32 22 436 or DE-OS 33 25 875. In these processes, the tungsten carbide is adhesively bonded onto the surface of the graphite by chemical reaction.

In this process, tungsten oxide or compound which can be thermally reacted to produce tungsten oxide is formed on the graphite and/or applied thereto. Thereafter, the tungsten oxide on the graphite is carburized and reduced at a temperature of 620° to 950° C., preferably a temperature of 750° to 950° C. in a flowing $CO/CO_2$ atmosphere.

In a preferred embodiment of the invention for fabricating the cathode/membrane assembly, the cathode material in the form of porous graphite, i.e. carbon fiber material, is coated with the surface active layer of tungsten carbide and the coated graphite is applied in a thin layer onto a proton conductive ion exchange membrane of any conventional type utilized in electrolysis.

The graphite may be so coated by impregnating it with para-ammoniumtungstate which can be thermally decomposed or reacted to form tungsten oxide at the temperature range of 620° to 950° C. and preferably 750° to 950° C. in a flowing $CO/CO_2$ atmosphere.

The para-ammoniumtungstate can be applied in an $NH_3$ or $H_2O_2$-containing aqueous solution which can further include a surface active agent, i.e. a wetting agent or tenside, to promote the wetting of the graphite with this solution.

Any wetting agents may be used for this purpose and, since the wetting agents are utilized in such small quantities as not to have any material effect after carburization, practically any of the vast variety of commercial wetting agents can be employed. The amount of wetting agent in the solution may be the equivalent of a few drops per liter.

The result is a particularly uniform coating of the graphite with tungsten carbide after carburization.

Alternatively, the graphite can be impregnated with a solution of tungsten hexachloride in alcohol (ethanol) which likewise gives rise to a uniform coating of the graphitic materials with tungsten carbide after reduction in carburization in the manner already described.

BRIEF DESCRIPTION OF THE RAWING

The above and other objects, features and advantages of the present invention will become more readily apparent from the following description, reference being made to the accompanying highly diagrammatic drawing, the sole FIGURE of which is a diagrammatic cross section through an electrolysis cell provided with a cathode/membrane unit according to the invention.

SPECIFIC DESCRIPTION

The electrolysis cell shown in the drawing comprises a vessel 10 which is subdivided by the cathode/membrane unit or assembly 14 into a cathode compartment and an anode compartment. The anolyte can be introduced into the anode compartment 11 through an inlet provided with a stop cock 12 and a continuous out-flow of electrolyte can beprovided with a stop cock 19. The anode 13 is an inert electrode composed, for example, of graphite.

The water accumulating in the cathode compartment and which carries the protons in their diffusion through membrane, collects at the bottom of the cathode compartment and can be drained by an outlet provided with a stop cock 17.

The cathode/membrane assembly comprises the solid electrolyte cation exchange membrane 16 and a thin layer 14 consisting of graphite fibers coated with tungsten carbide is prepared, e.g. by the method described below.

The cathode formed by the layer 15 is connected to the negative terminal of the electrolysis source 18 while the anode is connected to the positive terminal thereof. The hydrogen can be collected as represented by the vertical arrow.

SPECIFIC EXAMPLES

EXAMPLE 1

An ammoniacal aqueous solution of 40 grams per liter of p-ammoniumtunstate (pH 8) has a few drops of a nonionic surface active agent added thereto. The surface active agent is preferably of the IGEPAL ® type (see Pages 202 ff of "Surface Active Agents", Interscience Publishers, Inc., New York 1949 - Anthony M. Schwartz and James W. Perry).

Samples of graphite felt which have previously been cleaned in an ultrasonic bath of acetone were immersed at a temperature of 80° C. in this solution and subjected to ultrasonic impregnation wherein the solution was drawn through the felt by a vacuum generated by a water vacuum pump.

To so impregnated samples were dried over NaOH and then further dried in a desiccator either at 500° C. in air for one hour or at 450° C. under nitrogen. The samples were found to be coated with either $WO_3$ or blue tungsten oxide (a mixture of $WO_3$ and $WO_2$ so that the mixture appeared to have the composition $WO_{2.90}$). In an alternative approach, the samples were treated in a closed glass apparatus with HCl gas. After the precipitation of $WO_3.xHOH$, with an incubation time of up to an hour, the samples were then dried in air at 120° C..

Regardless of the way in which the oxide was formed and dried, the samples were then carburized at a temperature of about 900° C. under a stream of $CO/CO_2$ of about 90:40 by volume.

EXAMPLE 2

A 0.05 to 0.2 molar solution of $WCl_6$ was formed in absolute ethanol or in an absolute enthanol/acetone 50:50 mixture.

The graphite felt samples, following ultrasonic cleaning in acetone, were then immersed and impregnated with the $WCl_6$-containing alcoholic solution in an ultrasonic bath. After predrying for about 30 minutes at 100° to 120° C. in moist air, the graphite samples were dried at 350° C. in air for an hour. The $WO_3.xHOH$ impregnated samples were then subjected to carburization as described in Example 1.

EXAMPLE 3

The tungsten carbide coated graphite felt formed in Example 1 or Example 2 was then pressed against a cation exchange resin (NEOSEPTA ®) and the resulting assembly inserted into an electrolysis cell as described. The protons penetrating the membrane were reduced on the cathode surface with its tungsten carbide coating to $H_2$ and the resulting hydrogen was collected from the cathode compartment from above while the water diffusing with the protons through the membrane collected at the bottom of the cathode compartment and was discharged.

In a laboratory scale cell having a cathode surface area (geometric) of 125$cm^2$, using 45% by weight sulfuric acid as the anolyte, which was saturated with $SO_2$ and to which HI had been added as a depolarizer, the cell was effectively operated to generate hydrogen at 0.7 volts with a current density of 200 $mA/cm^2$ at an operating temperature of 80° C.

Extended operations showed no problems with poisoning of the cathode material.

We claim:

1. A method of making a cathode/membrane assembly for an electrolysis cell capable of producing hydrogen in a cathode compartment thereof, comprising:

a proton-permeable solid-electrolyte ion-exchange membrane; and on a surface of said membrane turned toward said cathode compartment, a layer of porous graphite in the form of carbonaceous fibers coated with tungsten carbide, said method comprising the steps of:

(a) impregnating a mat of graphite fibers with a solution of para-ammoniumtungstate or tungsten hexachloride;

(b) thermally converting the para-ammonium tungstate or tungstenhexachloride to tungsten oxide on the graphite fibers;

(c) carburizing the tungsten oxide on the graphite fibers to tungsten carbide at a temperature of substantially 620° C. to 950° C. in a carburizing atmosphere, thereby forming a cathode of tungsten-carbide-coated graphite fibers to constitute said layer; and (d) applying said cathode to a proton-permeable solid-electrolyte ion-exchange membrane by pressing said layer against said membrane to form said assembly.

2. The method defined in claim 1 wherein the temperature for carburizing said tungsten oxide is 750° C. to 950° C.

3. The method defined in claim 1 wherein said temperature is a stream of a $CO/CO_2$ mixture.

4. The method defined in claim 3 wherein said solution is an $NH_3$ or $H_2O_2$ containing aqueous solution of p-ammoniumtungstate to which a surface active wetting agent has been added.

5. The method defined in claim 3 wherein said solution is an alcohol aqueous solution of tungstenhexachloride.

* * * * *